US006469677B1

(12) United States Patent
Schaffner et al.

(10) Patent No.: US 6,469,677 B1
(45) Date of Patent: Oct. 22, 2002

(54) OPTICAL NETWORK FOR ACTUATION OF SWITCHES IN A RECONFIGURABLE ANTENNA

(75) Inventors: James H. Schaffner, Chatsworth; Tsung-Yuan Hsu, Westlake Village; Robert Y. Loo, Agoura Hills, all of CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 09/870,294

(22) Filed: May 30, 2001

(51) Int. Cl.[7] ..... H01Q 3/24

(52) U.S. Cl. ..... 343/876; 343/700 MS; 343/853

(58) Field of Search ..... 343/700 MS, 853, 343/876; 333/105, 258, 262

(56) References Cited

U.S. PATENT DOCUMENTS

| | | | | |
|---|---|---|---|---|
| 3,984,173 A | | 10/1976 | Shaw | 350/96 |
| 5,121,089 A | | 6/1992 | Larson | 333/107 |
| 5,248,931 A | | 9/1993 | Flesner et al. | 322/2 R |
| 5,293,172 A | | 3/1994 | Lamberty et al. | 343/701 |
| 5,334,551 A | | 8/1994 | Komatsu | 437/105 |
| 5,511,238 A | | 4/1996 | Bayraktaroglu | 455/81 |
| 5,541,614 A | | 7/1996 | Lam et al. | 343/792.5 |
| 5,578,976 A | | 11/1996 | Yao | 333/262 |
| 5,596,671 A | | 1/1997 | Rockwell, III | 385/147 |
| 5,657,407 A | | 8/1997 | Li et al. | 385/37 |
| 5,757,319 A | * | 5/1998 | Loo et al. | 342/375 |
| 5,961,924 A | | 10/1999 | Reichert et al. | 422/82.11 |
| 6,002,822 A | | 12/1999 | Strasser et al. | 385/48 |
| 6,046,659 A | | 4/2000 | Loo et al. | 333/262 |
| 6,069,587 A | * | 5/2000 | Lynch et al. | 343/700 MS |
| 6,198,438 B1 | * | 3/2001 | Herd et al. | 343/700 MS |
| 6,307,519 B1 | * | 10/2001 | Livingston et al. | 343/767 |
| 6,310,339 B1 | | 10/2001 | Hsu et al. | 250/214.1 |

FOREIGN PATENT DOCUMENTS

| | | | |
|---|---|---|---|
| WO | WO 99/50929 | 10/1999 | H01Q/1/38 |

OTHER PUBLICATIONS

Freeman, J.L. et al., "Optoelectronically Reconfigurable Monopole Antenna," Electronics Letters, vol. 28, No. 16, pp. 1502–1503 (Jul. 30, 1992).

(List continued on next page.)

*Primary Examiner*—Don Wong
*Assistant Examiner*—Hoang Nguyen
(74) *Attorney, Agent, or Firm*—Ladas & Parry

(57) ABSTRACT

Method and apparatus for actuating switches in a reconfigurable antenna array. Micro electro-mechanical system (MEMS) switches span gaps between antenna elements disposed on an antenna substrate. An integrated optic waveguide network which directs optical energy towards the MEMS switches is contained in a superstrate disposed above the antenna elements and substrate. The MEMS switches are formed on a semi-insulating substrate. When illuminated, the resistance of the semi-insulating substrate is lowered so as the reduce the resistance between the control contacts. The antenna array is reconfigured by directing optical energy to the photo-voltaic cells connected to selected MEMS switches to close those MEMS switches, thereby electrically connecting selected antenna elements and by directing optical energy to the semi-insulating substrate of selected MEMS switches to open those MEMS switches, thereby electrically disconnecting selected antenna elements.

22 Claims, 6 Drawing Sheets

OTHER PUBLICATIONS

Sun, C.K., et al., "Photovoltaic–FET For Optoelectronic RF/μwave Switching," *IEEE Transactions on Microwave Theory and Techniques*, vol. 44, No. 10, pp. 1747–1750 (Oct. 1996).

Huang, J., "Analysis of a Microstrip Reflectarray Antenna for Microspacecraft Applications," *TDA Progress Report* 42–120, pp. 153–173 (Feb. 15, 1995).

MAFET–III Final Report, "Low–Cost Antenna System on Mobile Warrior," N66001–96–C–8, pp. 40–45 (Aug. 1998).

Hyman, D., et al., "GaAs–Compatible Surface–Micromachined RF MEMS Switches," *Electronics Letters*, vol. 35, No. 3, pp. 224–226 (Feb. 4, 1999).

Giles, Randy, et al., "Highly Efficient Light–Actuated Micromechanical Photonic Switch for Enhanced Functionality at Remote Nodes," *OFC '98 Optical Fiber Communications Conference Technical Digest*, Postdeadline paper, pp. PD2–1 –PD2–4 (Feb. 1998).

Ramaswamy, R.V. and Srivastava, R., "Ion–Exhanged Glass Waveguides: A Review," *Journal of Lightwave Technology*, vol. 6, No. 6, pp. 984–1001 (Jun. 1988).

Selvaraj, Ravi, et al., "Integrated Optical Waveguides in Polyimide for Wafer Scale Integration," *Journal of Lightwave Technology*, vol. 6, No. 6, pp. 1034–1044 (Jun. 1988).

Nishihara, Hiroshi, et al., *Optical Integrated Circuits*, McGraw–Hill Book Co., New York, pp. 62–95, 205–223, (1989).

Ura, Shogo, et al., "An Integrated–Optic Disk Pickup Device," *Journal of Lightwave Technology*, vol. LT–4, No. 7, pp. 913–918 (Jul. 1986).

Hashimoto, Toshikazu, et al., "Multichip Optical Hybrid Integration Technique with Planar Lightwave Circuit Platform," *Journal of Lightwave Technology*, vol. 16, No. 7, pp. 1249–1258 (Jul. 1998).

* cited by examiner

OPTICAL NETWORK FOR ACTUATION OF SWITCHES IN A RECONFIGURABLE ANTENNA

FIELD OF THE INVENTION

This invention relates to reconfigurable antenna systems, and more particularly, to an apparatus and method for reconfiguring antenna elements in a reconfigurable antenna array.

BACKGROUND OF THE INVENTION

Reconfigurable antenna systems have applications in satellite and airborne communication node (ACN) systems where wide bandwidth is important and where the antenna aperture must be continually reconfigured for various functions. These antenna systems may comprise an array of individually reconfigurable antenna elements. An antenna array comprised of reconfigurable dipole elements can be reconfigured by varying the resonant length of one or more of the elements. The ability to dynamically vary the resonant length of a dipole antenna enables the antenna to be operated efficiently within multiple frequency ranges.

One means of varying the resonant length of a dipole antenna is to segment the antenna lengthwise on either side of its feed point. The resonant length of the antenna may then be varied by connecting or disconnecting successive pairs of adjacent dipole segments. Connection of a pair of adjacent dipole segments may be effected by coupling each segment to a switch. The adjacent segments are then joined by closing the switch.

Previous designs for reconfigurable antennas have been proposed which incorporate photoconductive switches as an integral part of an antenna element in an antenna array. See "Optoelectronically Reconfigurable Monopole Antenna," J. L. Freeman, B. J. Lamberty, and G. S. Andrews, *Electronics Letters,* Vol. 28, No. 16, Jul. 30, 1992, pp. 1502–1503. Also, the possible use of photovoltaic activated switches in reconfigurable antennas has been explored. See C. K. Sun, R. Nguyen, C. T. Chang, and D. J. Albares, "Photovoltaic-FET For Optoelectronic RF/Microwave Switching," *IEEE Trans. On Microwave Theory Tech.,* Vol. 44, No. 10, October 1996, pp. 1747–1750. One problem with these designs, however, is that the performance of ultra-broadband systems (i.e., systems having an operating frequency range of approximately 0–40 GHz) utilizing these types of switches suffers in terms of insertion loss and electrical isolation.

Radio frequency micro-electromechanical system (RF MEMS) switches have been proven to operate over the 0–40 GHz frequency range. A representative example of this type of switch is disclosed in Yao, U.S. Pat. No. 5,578,976. Previous designs for reconfigurable antennas using RF MEMS switches incorporated metal feed structures to apply an actuation voltage from the edge of a substrate to the RF MEMS switch bias pads. A problem with the use of metal feed structures to apply an actuation voltage to the switches is that, in an antenna array, the number of switches can grow to thousands, requiring a complex network of bias lines routed all around the switches. These bias lines can couple to the antenna radiation field and degrade the radiation pattern of the antenna array. Even when the bias lines are hidden behind a metallic ground plane, radiation pattern and bandwidth degradation can occur unless the feed lines and substrate feed through via conductors are very carefully designed because each element in the antenna array may accommodate tens of switches. This problem is magnified enormously as the number of reconfigurable elements increases. Thus, a need exists for an improved apparatus and method for actuating switches in a reconfigurable antenna array.

SUMMARY OF THE INVENTION

Accordingly, an object of the present invention is to provide a means for actuating RF MEMS switches without the need for metal feed structures coupled to the switches. Further objects and advantages of the invention will become apparent from a consideration of the drawings and following description.

The present invention uses a series of MEMS switches to reconfigure an antenna element in a reconfigurable antenna system. The MEMS switches and antenna element are mounted on a semi-insulating substrate. The MEMS switches are actuated by optical energy conveyed to the switches via an optical waveguide network integrated into a superstrate, which is coupled to the substrate. Preferably, the superstrate is radio frequency (RF) transparent. The RF transparent superstrate functions both as a framework for incorporation of the optical waveguide network and as a radome for the reconfigurable antenna system.

DETAILED DESCRIPTION

Figure 1:
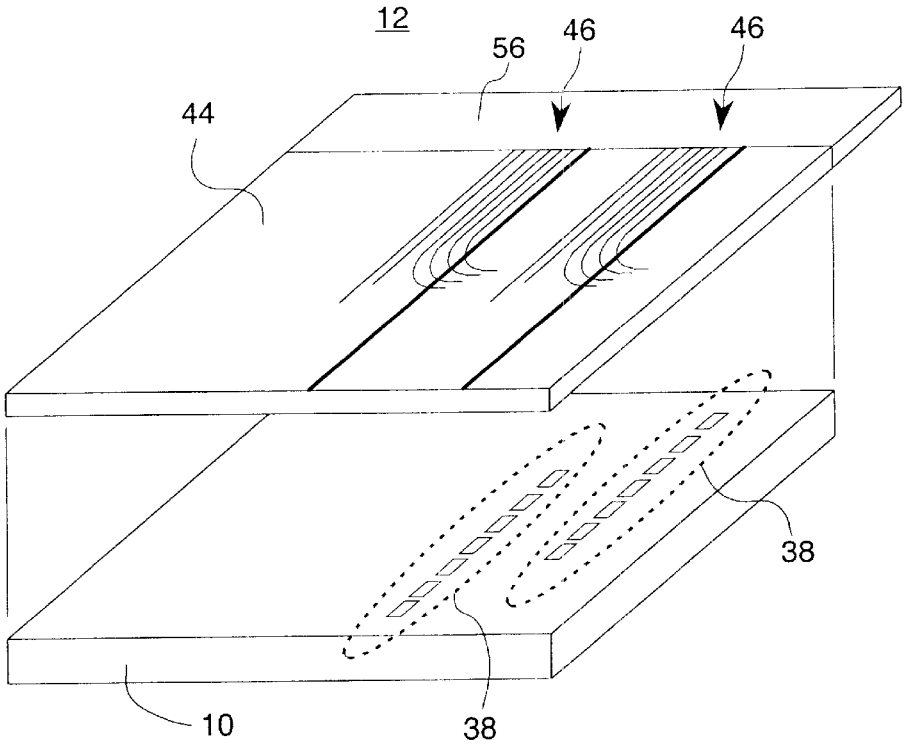
FIG. 1 is a perspective view of the present invention showing the substrate, incorporating the reconfigurable antenna array, and the superstrate, incorporating the integrated waveguide network.

FIG. 1 shows a reconfigurable antenna array 12 according to an embodiment of the present invention. Reconfigurable antenna array 12 comprises a plurality of reconfigurable dipole antenna elements 38 formed on a surface of substrate 10, a superstrate 44 coupled to the substrate 10 and incorporating an integrated optic waveguide network 46, and an optical energy generating means 56 coupled to waveguide network 46 for generating optical energy to be conveyed through waveguide network 46 to effect reconfiguration of antenna elements 38. Optical energy generating means 56 may comprise a linear or matrix LED array or a laser array.

While only two representative antenna elements 38 are illustrated in FIG. 1, it is to be understood that the number of elements actually used in a particular application will depend on the particular requirements of that application. Many applications will require large antenna arrays with hundreds or even thousands of antenna elements.

Figure 2:
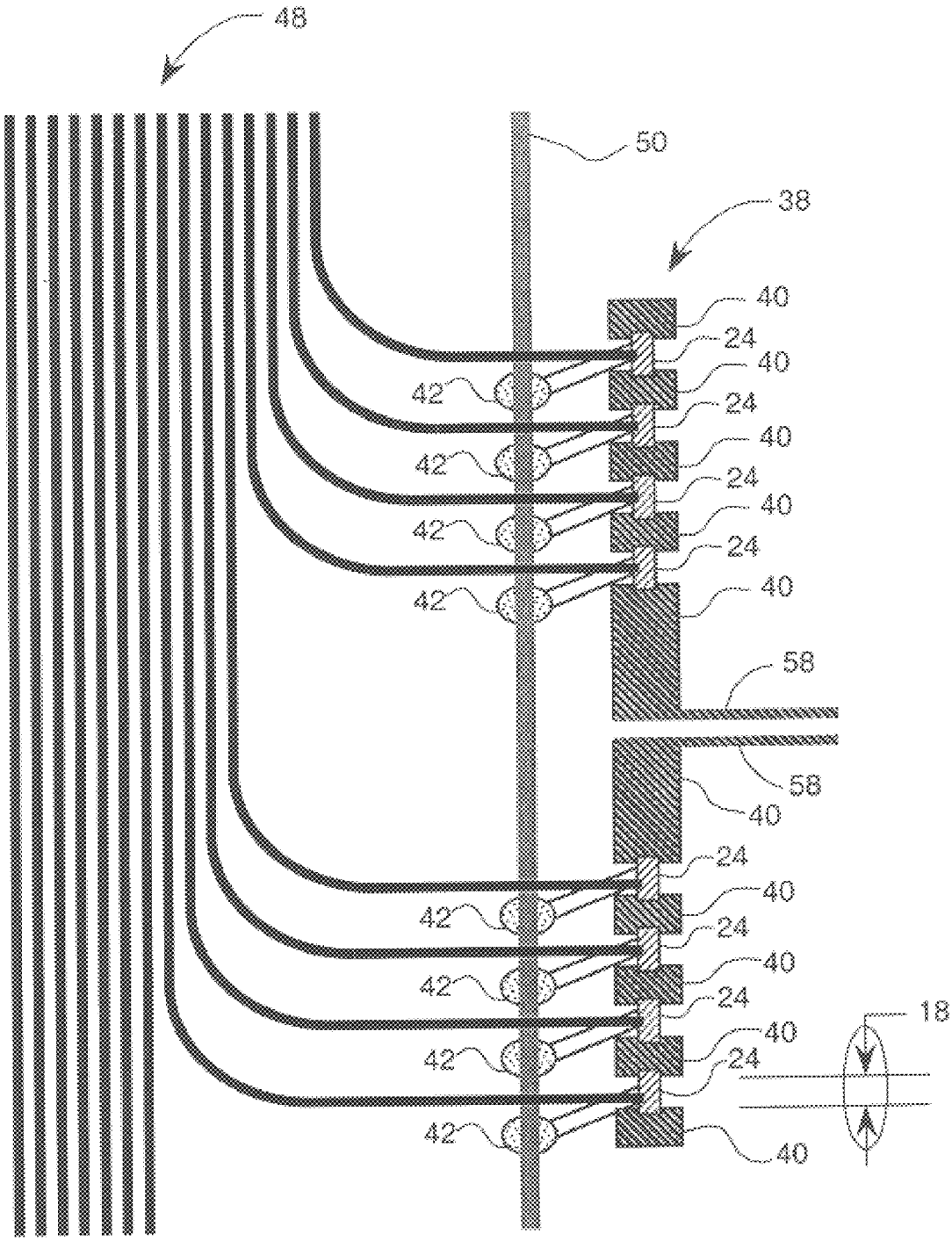
FIG. 2 shows a representative reconfigurable dipole antenna element of the antenna array of the preferred embodiment of the present invention.

FIG. 2 shows, in greater detail, a representative reconfigurable dipole antenna element 38 of antenna array 12. Antenna element 38 comprises a twin antenna feed structure 58, a radiating structure comprising series of adjacent metal strip segments 40 formed on substrate 10 (as shown in FIG. 1) and extending to either side of feed structure 58, and RF MEMS switches 24 coupled to each successive pair of adjacent metal strip segments 40. A gap 18 separates adjacent metal strips 40. Gap 18 is opened and closed by operation of the RF MEMS switches 24, in a manner to be explained later. The optical elements used to control the RF MEMS switches will also be explained later.

Figure 3:
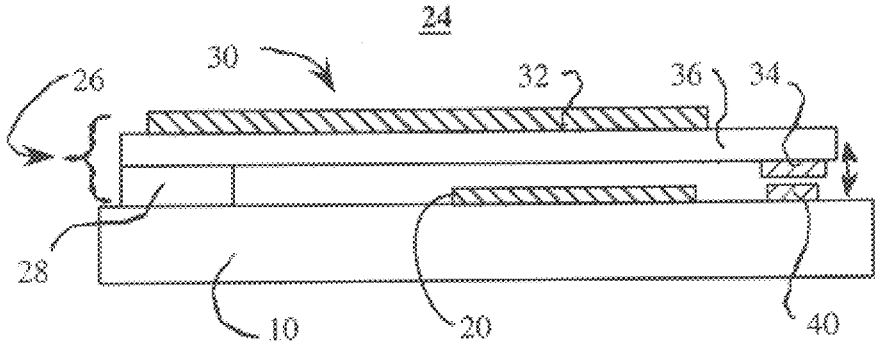
FIG. 3 shows a representative type of MEMS switch which may be incorporated into the present invention.

FIG. 3 shows one form of an RF MEMS switch which may be incorporated into the present invention. The microelectromechanical system switch, generally designated 24, is fabricated using generally known microfabrication techniques, such as masking, etching, deposition, and lift-off. In the preferred embodiment, RF MEMS switches 24 are directly formed on the substrate 10 and monolithically integrated with the metal segments 40. Alternatively, the RF MEMS switches 24 may be discreetly formed and then bonded to substrate 10. Referring once more to FIG. 2, one RF MEMS switch 24 is positioned proximate each gap 18 between pairs of adjacent metal strips 40 formed on the substrate 10. As seen in FIG. 3, the switch 24 comprises a substrate electrostatic plate 20 and an actuating portion 26. The substrate electrostatic plate 20 (typically connected to ground) is formed on the substrate 10. The substrate electrostatic plate 20 generally comprises a patch of a metal not easily oxidized, such as gold, for example, deposited on substrate 10. Actuation of the switch 24 opens and closes the gap 18 between the adjacent metal strips 40, in a manner to be explained later.

The actuating portion 26 of the switch 24 comprises a cantilever anchor 28 affixed to the substrate 10, and an actuator arm 30 extending from the cantilever anchor 28. The actuator arm 30 forms a suspended micro-beam attached at one end to the cantilever anchor 28 and extending over and above the substrate electrostatic plate 20 and the gap 18 between adjacent metal strips 40 on the substrate 10. The cantilever anchor 28 may be formed directly on the substrate 10 by deposition buildup or by etching away surrounding material, for example. Alternatively, the cantilever anchor 28 may be formed with the actuator arm 30 as a discrete component and then affixed to the substrate 10. The actuator arm 30 may have a bilaminar cantilever (or bimorph) structure. Due to its mechanical properties, the bimorph structure exhibits a very high ratio of displacement to actuation voltage. That is, a relatively large displacement (approximately 300 micrometers) can be produced in the bimorph cantilever in response to a relatively low switching voltage (approximately 20 V).

A first layer 36 of the actuator arm structure comprises a semi-insulating or insulating material, such as polycrystalline silicon. A second layer 32 of the actuator arm structure comprises a metal film (typically aluminum or 0. gold) deposited atop first layer 36. The second layer 32 typically acts as an electrostatic plate during operation of the switch. In the remainder of the description, the terms "second layer" and "arm electrostatic plate" will be used interchangeably. As shown in FIG. 3, the second layer 32 is coupled to and extends from the cantilever anchor 28 toward the position on the actuator arm 30 at which electrical contact 34 is formed. As the height of the cantilever anchor 28 above the substrate 10 can be tightly controlled using known fabrication methods, locating the second layer 32 proximate the cantilever anchor 28 enables a correspondingly high degree of control over the height of the second layer 32 above the substrate 10. As the switch actuation voltage is dependent upon the distance between the substrate electrostatic plate 20 and the arm electrostatic plate 32, a high degree of control over the spacing between the electrostatic plates is necessary in order to repeatably achieve a desired actuation voltage. In addition, at least a portion of the second layer 32 comprising the arm electrostatic plate, and a corresponding portion of the actuator arm 30 on which second layer 32 is formed, are positioned above the substrate electrostatic plate 20 to form an electrostatically actuatable structure. An electrical contact 34, typically comprising a metal that does not oxidize easily, such as gold, platinum, or gold palladium, for example, is formed on the actuator arm 30 and positioned on the arm so as to face the gap 18 formed between adjacent metal strips 40.

Figure 4:
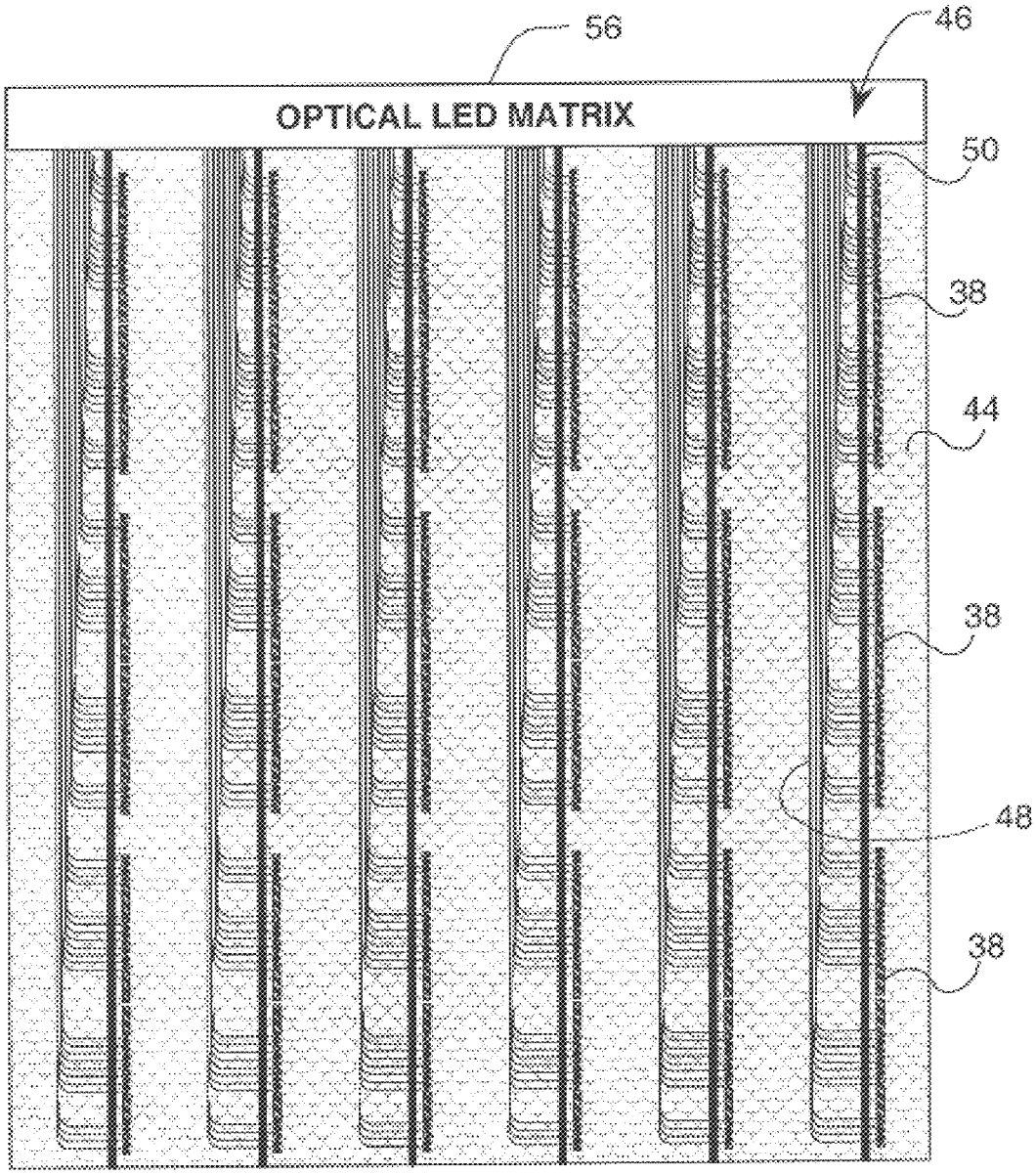
FIG. 4 is a plan view of the present invention showing the substrate incorporating the reconfigurable antenna array, and the superstrate incorporating the integrated waveguide network.

As shown in FIG. 2, a photovoltaic (PV) cell 42 is coupled to each RF MEMS switch 24, each PV cell 42 having a pair of electrical contacts. The PV cell electrical contacts are coupled to the substrate and arm electrostatic plates 20 and 32, respectively, of the RF MEMS switch. Referring to FIG. 4 in conjunction with FIG. 2, the superstrate 44 incorporates an integrated optic waveguide network 46. Preferably, the superstrate provides less than 1 dB of loss to radio frequency (RF) signals at the frequencies of interest that are radiated onto the superstrate 44, effectively making the superstrate 44 transparent to radio frequency signals. When coupled to the substrate 10, the superstrate 44 forms a microwave transparent radome positioned over the substrate 10 and incorporating the reconfigurable antenna array elements 38. The superstrate 44 may be formed from any suitable RF transparent semi-insulating material that can support the fabrication of optical waveguide network 46. An example of suitable radome material is a glass or a polymer. The design and fabrication of optical waveguides is well-known in the art. For example, see "Ion-Exchanged Glass Waveguides: A Review," by R. V. Ramaswamy and R. Srivastava, Journal of Lightwave Technology., vol. 6, no. 6, June 1988, pp. 984–1001; also, "Integrated Optical Waveguides In Polyimide For Wafer Scale Integration", by R. Selvaraj, H. T. Lin, and J. F. McDonald, Journal of Lightwave Technology, vol. 6, no. 6, June 1988, pp. 1034–1044. Fabrication of integrated waveguide network 46 generally entails forming a series of relatively high refractive index pathways, or waveguides, within a matrix comprised of a relatively lower refractive index material. The relatively lower refractive index material thus functions as cladding, encasing the relatively high refractive index waveguide. Waveguides 48 and 50 may be expediently fabricated by one of two methods. The first method comprises depositing a metal such as titanium on the surface of the superstrate 44, delineating the waveguide pattern using standard lithography techniques, then raising the temperature of the superstrate 44 to cause an indiffusion process after which the material on the surface is diffused into the superstrate, causing a local increase in its optical index of refraction to form the waveguiding region. Alternatively, the delineation of the surface of the superstrate 44 is done using photolithographic techniques followed by exposure to a solution which exchanges certain atoms in the superstrate 44 with atoms in the solution, causing the index in the delineated regions to be increased thereby creating the waveguides 48 and 50. Some combination of the two foregoing techniques may also be used to form the waveguides 48 and 50.

Integrated waveguide network 46 comprises RF MEMS switch waveguides 48 and PV cell waveguides 50. The PV cell waveguides 50 channel optical energy for the purpose of illuminating PV cells 42, thus causing a voltage to be generated across the PV cell terminals. The RF MEMS switch waveguides 48 channel optical energy for the direct illumination of the RF MEMS switches 24. Each RF MEMS switch waveguide 48 terminates at and illuminates an RF MEMS switch 24.

Each waveguide 48, 50 is coupled to an optical energy generating means 56, such as a laser or an LED array. The optical energy generating means shown in FIG. 4 is an LED array. Light may be drawn off from the PV cell waveguide 50 or RF MEMS switch waveguide 48 and directed to a PV cell 42 or RF MEMS switch 24 through the use of such well-known means as a waveguide tap or a grating coupler formed in the superstrate 44. When the superstrate 44 is coupled to the substrate 10, one such waveguide tap or grating coupler will be positioned directly above each RF MEMS switch 24 in the antenna array 12 so as to direct light onto the switch 24.

Waveguide taps and grating couplers are well-known in the pertinent art. For example, see Optical Integrated Circuits, by H. Nishihara, M. Haruna, and T. Suhara, McGraw-Hill Book Co., New York, 1989, pp. 62–95. Some examples of waveguide taps known in the art are disclosed in U.S. Pat. Nos. 6,002,822 and 5,596,671. Light traveling through a waveguide is confined within a core optical material that has an refractive index that is higher than the surrounding cladding material. A waveguide tap forces the light, normally confined primarily to the waveguide core, to "leak" out of the core at a desired spatial location. The waveguiding effect is destroyed by mechanically or chemically reducing the index difference between the core and the cladding along a certain distance. Some examples of grating couplers known in the art are disclosed in U.S. Pat. Nos. 5,657,407 and 5,961,924. Another example of a grating coupler is described by S. Ura, T. Suhara, H. Nishihara and J. Koyama, in "An Integrated-Optic Disk Pickup Device", Journal of Lightwave Technology, LT-4, 913–917 (1986). A grating coupler generally comprises a series of grating teeth disposed on the surface of or within the optical waveguide through which light energy may be radiated out of the waveguide. Grating couplers can be fabricated using conventional electron-beam lithography techniques.

The spacing between the superstrate 44 and the substrate 10 must be sufficient to ensure focused optical coupling to a PV cell 42 or RF MEMS switch 24 positioned on the substrate 10, while allowing adequate space for the mechanical motion of the RF MEMS switch 24. The exact spacing required will depend on factors such as the configuration of the RF MEMS switches 24 employed and the sizes of the PV cells 42 used.

The superstrate 44 can be spaced above the substrate 10 using deposited or etched spacers. For a glass waveguide, and hence a glass superstrate, a dielectric material, such as silicon dioxide, can be deposited on the superstrate to form stand-offs for spacing the superstrate from the substrate. An alternative approach would be to cement glass stand-offs on the superstrate and then polish these down to the thickness needed to achieve a desired spacing between the superstrate and the substrate. For a polymer waveguide, a second layer of a different polymer could be spun onto the superstrate after waveguide formation. This could then be etched away so as to leave stand-offs projecting from the superstrate.

Positioning of the superstrate 44 with respect to the substrate 10 is determined by the location of the optical waveguides, 48, 50. Features such as waveguide taps and grating couplers incorporated into to the superstrate 44 are preferably positioned directly over an RF MEMS switch 24 or PV cell 42 so that the light from the waveguide shines on the device 24, 42. To aid in positioning of the superstrate 44 with respect to the substrate 10, optical lithography may be used to produce alignment markers on the superstrate 44 to be aligned with corresponding markers on the substrate 10. This positioning can be realized using micrometers or piezoelectric positioning devices of the type used in fiber optic device assembly.

For optimum optical coupling, the waveguide taps or grating couplers incorporated into the superstrate 44 and the corresponding PV cells 42 or RF MEMS switches 24 on the substrate 10 should preferably remain aligned within a radius of approximately 20 microns. Misalignment between the waveguide taps (or grating couplers) incorporated into the superstrate 44 and the corresponding PV cells 42 or RF MEMS switches 24 on the substrate 10 may result from initial errors in the placement and coupling of the superstrate 44 to the substrate 10. Additional possible causes of misalignment are mechanical stresses in the substrate 10 and/or superstrate 44, and thermal expansion differentials caused by differences between the thermal expansion coefficients of the substrate 10 and superstrate 44. Existing methods, such as the use of mask aligners, can provide the requisite accuracy in alignment during fabrication.

The operation of the preferred embodiment will now be discussed. Actuation of the RF MEMS switches 24 residing in a single antenna element 38 is effected by transmission of optical energy through PV cell waveguide 50. Light generated by a portion of optical energy generating means 56 (here, an LED array located on the edge of the superstrate 44) is coupled to the optical waveguide network 46 using known methods and channeled through PV cell waveguide 50. Waveguide taps direct light away from the PV cell waveguide 50 and onto the PV cells 42, illuminating the PV cells 42.

Figure 8:
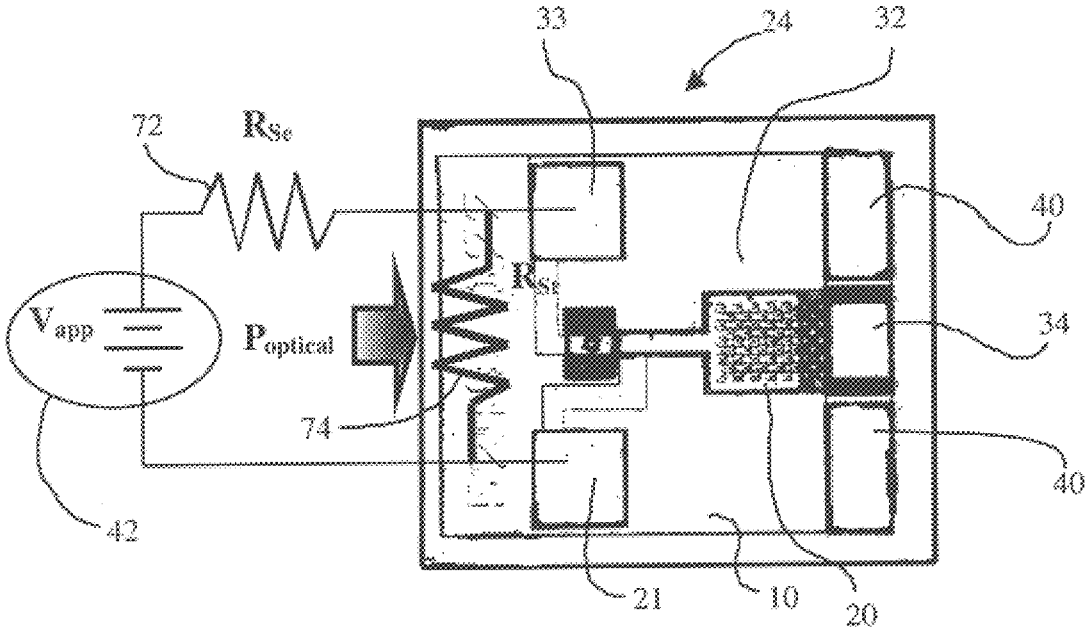
FIG. 8 is a schematic representation of a photo-voltaic cell coupled to a representative type of MEMS switch which may be incorporated into the present invention.

FIG. 8 illustrates schematically a PV cell 42 coupled to an RF MEMS switch 24. The PV cell 42 is coupled to a substrate plate contact 21 and an arm plate contact 33 through an externally provided resistance 72 having a resistance vale of $R_{Se}$. The substrate plate contact 21 is electrically connected with the substrate electrostatic plate 20 and the arm plate contact is electrically connected to the arm electrostatic plate 32. When the PV cell 42 is illuminated, a voltage $V_{app}$ is induced across the PV cell electrical contacts and, correspondingly, across substrate and arm electrostatic plates 20 and 32 of the RF MEMS switch 24 coupled to that PV cell 42. The RF MEMS switch is closed by means of this electrostatic attraction between the substrate electrostatic plate 20 located on substrate 10 and the arm electrostatic plate 32 located on actuator arm 30.

With switches 24 in the open state, a gap exists between adjacent metal strips 40 constituting dipole antenna element 38. When voltage $V_{app}$ is induced across the electrostatic plates 20 and 32 by illumination of the PV cell 42, the arm electrostatic plate 32 is attracted electrostatically toward substrate electrostatic plate 20, forcing actuator arm 30 to deflect toward substrate 10. Deflection of actuator arm 30 toward first substrate electrostatic plate 20, in the direction indicated by arrow 11 in FIG. 3, causes the electrical contact 34 to come into contact with adjacent metal strips 40, thereby bridging gap 18 between the metal strips. The amount of light required to close the RF MEMS switches 24 will depend upon the PV cell design and the required actuation voltage. For example, a 7 V driving voltage from a InGaAs PV cell results from 100 pW of illumination at 1550 nm wavelength. Thus, 10–20 mW of optical energy should easily drive tens of PV cells 42 in a column to provide switch actuation voltages of 20–30 V. As light from a single PV cell waveguide 48 is tapped to engage all of the RF MEMS switches 24 residing in a single antenna element 38, in the normal operating mode of the first embodiment all of the RF MEMS switches 24 will be closed.

Key aspects of the present invention are that substrate electrostatic plate 20 and arm electrostatic plate 32 are insulated from the metal strips 40 constituting antenna element 38, and that electrostatic plates 20 and 32 are dielectrically isolated, even when the switch is closed. Thus, no steady-state bias current is needed for the switch to operate. Also, since no steady DC current flows from the PV cell 42 (only a transient current that builds up an electric field across the electrostatic plates), the PV cell 42 can be made small. Higher voltages $V_{app}$ can be obtained by using an array of PV cells 42 connected in series.

The opening of the RF MEMS switches 24 in order to reconfigure dipole antenna element 38 will now be discussed. Opening of the RF MEMS switches 24 is effected in the following manner by transmission of optical energy through RF MEMS switch waveguides 48.

When actuation voltage $V_{app}$ is applied to RF MEMS switch 24, the voltage appearing across substrate electrostatic plate 20 and arm electrostatic plate 32 is given by the relationship $$V_{app}R_{st}/(R_{st}+R_{se})$$

where $R_{St}$ is the resistance of semi-insulating substrate 10 between substrate electrostatic plate 20 and arm electrostatic plate 32 (represented as the resistor 74 in FIG. 8), and $R_{Se}$ is the externally added series resistance 72 on the order of a megohm (this resistance can be monolithically integrated with the RF switch 24). When the RF MEMS switch 24 is not illuminated, $R_{St}$ is much larger than the series resistance $R_{Se}$, so that almost the entire voltage produced by illumination of the PV cell 42 appears across the RF MEMS switch electrostatic plates 20 and 32.

However, a semi-insulating substrate, comprised of a substance such as gallium arsenide or polycrystalline silicon, will be photoconductive. Thus, when optical energy from the RF MEMS switch waveguide 48 illuminates the portion of semi-insulating substrate 10 insulating the RF MEMS switch substrate electrostatic plate 20 from the RF MEMS switch arm electrostatic plate 32, the optical energy $h^{\nu}$ transferred to substrate 10 causes a proportion of the outer valence electrons of the substrate's constituent atoms to break free of their atomic bonds, thus creating free carriers. These free electrons are capable of carrying an electric current. Thus, when the RF MEMS switch 24 is illuminated, $R_{St}$ is reduced by the photoconducting process and becomes much lower than $R_{Se}$. Consequently, the voltage drop $V_{app}$ across the electrostatic plates falls below the level required to close the RF MEMS switch 24, causing the switch to open, interrupting the connection between adjacent metal strips 40 and changing the resonant length of dipole antenna element 38. Individual switches 24 can be opened by activating the appropriate LED in the LED array 56. Light from this LED will then be coupled to the appropriate RF MEMS switch waveguide 48.

Figure 7:
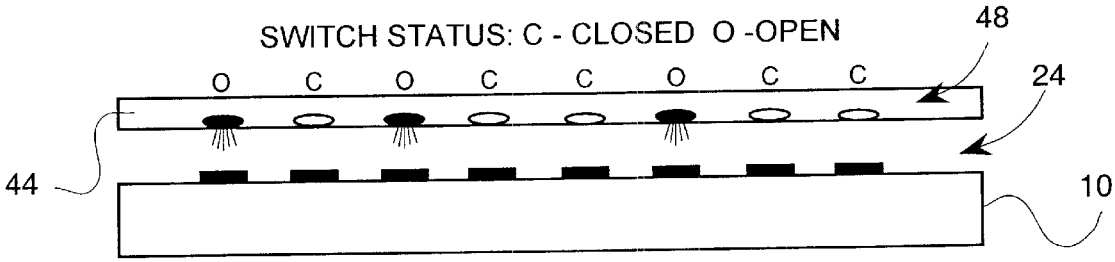
FIG. 7 is a cross-sectional view of the substrate and the superstrate illustrating the operation of the present invention.

FIG. 7 shows a cross section of the antenna array where the switches 24 that are open have light from the RF MEMS switch waveguide 48 shining directly upon them. Since the typical width of an optical waveguide is 6–25 microns, hundreds of optical waveguides per inch could originate from the edge of the superstrate 44, even when the waveguides are separated by up to 8 times the waveguide width to prevent optical cross-coupling.

Figure 5:
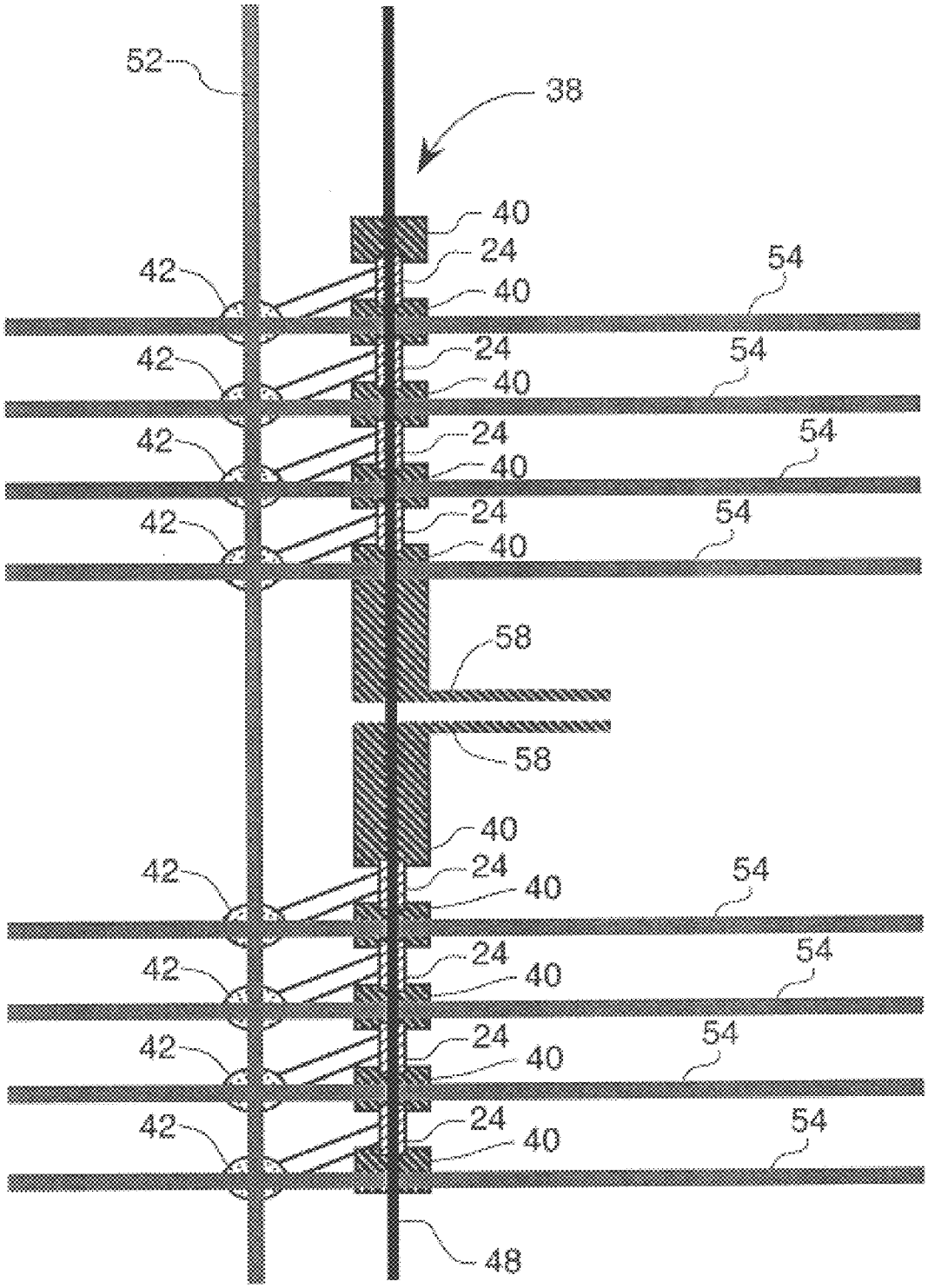
FIG. 5 shows a representative reconfigurable dipole antenna element of the antenna array of an alternative embodiment of the present invention.
Figure 6:
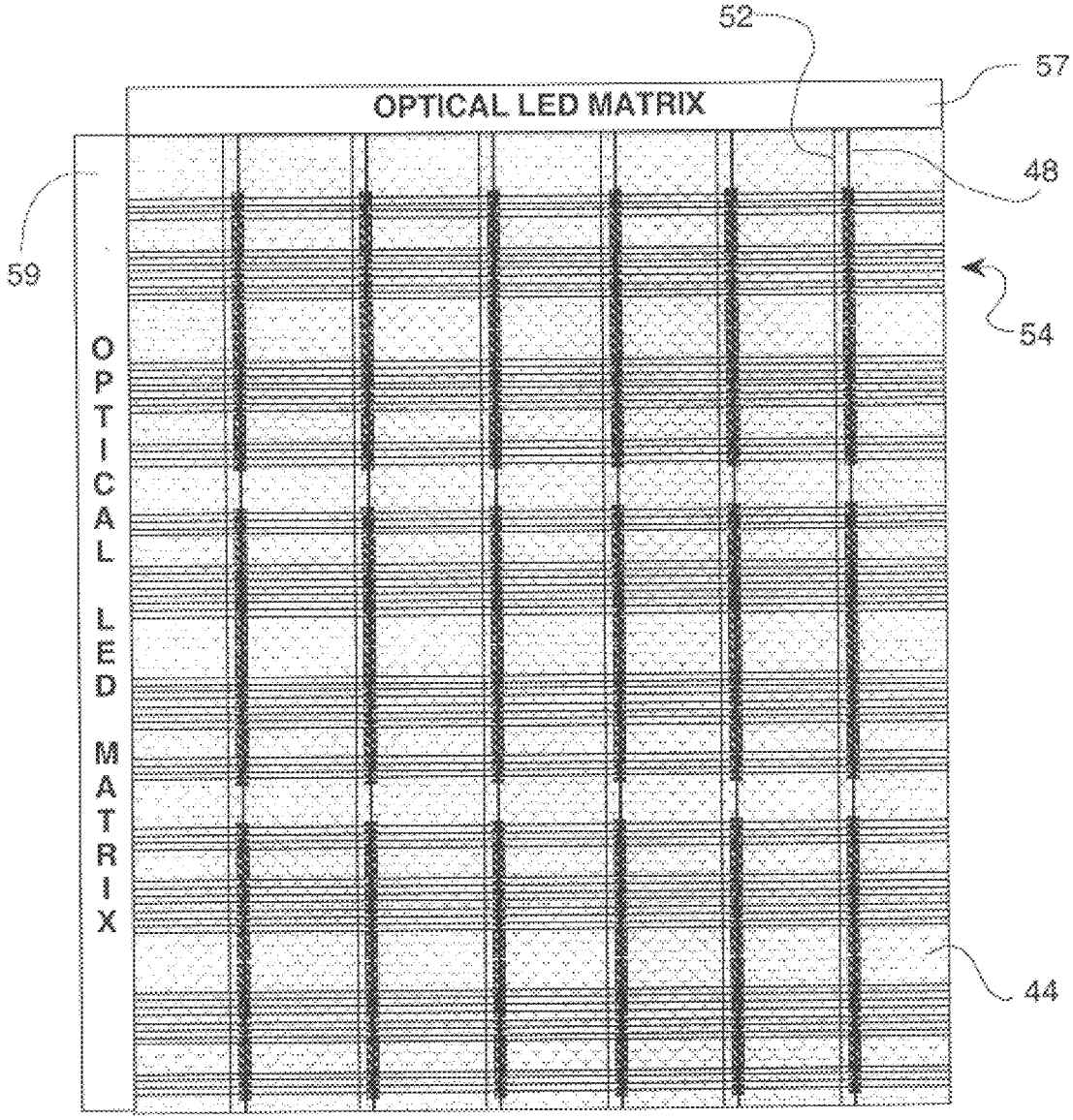
FIG. 6 is a plan view of an alternative embodiment of the present invention showing the substrate incorporating the reconfigurable antenna array, and the superstrate incorporating the integrated waveguide network.

An alternative embodiment of the reconfigurable dipole antenna element 38 of antenna array 12 is shown in FIG. 5. The arrangement shown in FIG. 5 is representative for each antenna element 38. Here, a series of PV cell waveguides form a matrix, with at least a horizontal PV cell waveguide 54 and a vertical PV cell waveguide 52 crossing over each PV cell 42. A separate RF MEMS switch waveguide 48 extends over the RF MEMS switches as shown in FIG. 5. The RF MEMS switch and PV cell waveguides 48, 52, 54 may be illuminated by optical LED matrices 57, 59 that are located on the edge or edges of the superstrate 44, as shown in FIG. 6. The optical LED matrices may comprise a horizontal LED matrix 59 that provides optical power to and controls the horizontal PV cell waveguides 54 and a vertical LED matrix 57 that provides optical power to and controls the vertical PV cell waveguides 52 and the RF MEMS waveguides 48. Alternative light sources, such as laser sources, may also be used to supply optical energy to the waveguides 48, 52, 54.

Operation of the alternative embodiment will now be discussed. Operation of the alternative embodiment can best be understood by reference to FIG. 5. Initially, all of the RF MEMS switches 24 are open. To activate the switches, each switch is addressed sequentially in a raster scan, the appropriate LED's being turned on if a particular switch 24 is to be closed. At an individual PV cell 42, each PV cell waveguide 52, 54 positioned over a PV cell 42 is tapped so that a fraction of the light flowing through the waveguide 52, 54 is incident upon the PV cell 42. The waveguide taps and the PV cells 42 are designed such that illumination of a PV cell 42 by light tapped from a single PV cell waveguide 52, 54 will not enable the cell 42 to generate a voltage sufficient to close the switch 24. Thus, the amount of light required to close an RF MEMS switch 24 is such that both of the waveguides 52, 54 crossing above a PV cell 42 must be illuminated in order to close the switch 24. If leakage of the charge from the switch electrostatic plates is small (due to the high resistances of the substrate and PV cell), then the switch 24 will remain closed for a length of time, even if no light flows through PV cell waveguides 52, 54. When the array 12 is to be reconfigured, light is channeled through the RF MEMS waveguide 48, which lies directly above the RF MEMS switches 24. Taps in the RF MEMS waveguide 48 direct light from the waveguide 48 onto the RF MEMS switches 24, illuminating the switches 24. Leakage paths are thus provided for each switch 24 to discharge, and all switches 24 are opened, and ready for the next raster scan. Although the optical waveguides 48, 52, 54 cross over each other at 90 degree angles in the drawing figures, no energy is coupled from one guide to the other.

Thus, the reader will see that the present invention provides reliable actuation of switches in a reconfigurable antenna without the need for an intricate network of metallic bias lines proximate the antenna elements.

Although the present invention has been described with respect to specific embodiments thereof, various changes and modifications can be carried out by those skilled in the art without departing from the scope of the invention. In particular, the substrate, actuator portion of the switch, electrostatic plates, the metal contact formed on the actuator portion of the switch, and the metal segments comprising the antenna element may be fabricated using any of various materials appropriate for a given end use design. The substrate, actuator portion of the switch, electrostatic plates, the metal contact formed on the actuator portion of the switch, and the metal segments comprising the antenna element may also be formed in various geometries. It is intended, therefore, that the present invention encompass such changes and modifications as fall within the scope of the appended claims.

What is claimed is:

1. An apparatus for reconfiguring antenna elements in a reconfigurable antenna array, the antenna elements spaced apart by gaps and the apparatus comprising:

a plurality of micro electromechanical system (MEMS) switches positioned proximate the gaps between the antenna elements and operable to make electrical connection between adjacent antenna elements across the gaps;

a plurality of optically controlled switch control circuits, one of the plurality of the switch control circuits coupled to each MEMS switch;

a superstrate positioned above the antenna elements at a predetermined distance therefrom and incorporating an optical waveguide network including a plurality of switch control waveguides, each of the waveguides coupled to a corresponding at least one of the plurality of switch control circuits for controlling at least one corresponding switch; and an optical energy supply for providing optical energy to particular switch control waveguides within the integrated optical waveguide network to control selected MEMS switches and thereby control the electrical connection of adjacent antenna elements.

2. The apparatus as claimed in claim 1, wherein each MEMS switch has two control contacts and is electrostatically actuatable to an open state or a closed state by a voltage applied between the two control contacts and each switch control circuit comprises:

one or more photo-voltaic cells connected in series;

a series resistance connecting the one or more photo-voltaic cells to the control contacts; and a photoresistive cell connected between the control contacts.

3. The apparatus as claimed in claim 2, wherein the plurality of switch control waveguides comprises:

one or more photo-voltaic cell waveguides, each photo-voltaic cell waveguide providing optical energy to the photo-voltaic cell or cells of one or more switch control circuits, wherein the provision of optical energy actuates the MEMS switch connected to the switch control circuit to the closed state of the MEMS switch; and a plurality of MEMS switch waveguides, one of said MEMS switch waveguides providing optical energy to the photoresistive cell of each switch control circuit, wherein the provision of optical energy to the photoresistive cell actuates the MEMS switch to the open state of the MEMS switch.

4. The apparatus as claimed in claim 2, wherein the plurality of switch control waveguides comprises:

one or more MEMS switch waveguides, each MEMS switch waveguide providing optical energy to the photoresistive cell of one or more switch control circuits, wherein the provision of optical energy to the photoresistive cell actuates the MEMS switches connected to the one or more switch circuits to the open state of the MEMS switches;

a plurality of horizontal photo-voltaic cell waveguides; and a plurality of vertical photo-voltaic cell waveguides, wherein the MEMS switch connected to a switch control circuit is actuated to the closed state of the MEMS switch by the optical energy provided by at least one horizontal photo-voltaic cell waveguide and at least one vertical photo-voltaic cell waveguide providing optical energy to the photo-voltaic cell or cells of the switch control circuit.

5. The apparatus as claimed in claim 2, wherein each MEMS switch is formed on a semi-insulating substrate and the photoresistive cell comprises a portion of the semi-insulating substrate.

6. The apparatus as claimed in claim 5, wherein the antenna elements and the MEMS switches are formed on a single substrate.

7. The apparatus as claimed in claim 5, wherein the antenna elements are formed on an antenna substrate and one or more MEMS switches is formed discreetly from and then affixed to the antenna substrate.

8. The apparatus as claimed in claim 1 further including grating couplers for coupling optical energy from the waveguides to the switch control circuits.

9. The apparatus as claimed in claim 1 wherein the optical energy supply comprises an LED array.

10. The apparatus as claimed in claim 1 wherein the optical energy supply comprises a laser array.

11. The apparatus as claimed in claim 1, wherein the superstrate is RF transparent.

12. A method of reconfiguring an antenna array, the method comprising the steps of:

providing a plurality of adjacent antenna elements, the antenna elements being separated from each other by gaps;

providing a plurality of micro electromechanical system (MEMS) switches positioned proximate the gaps between the antenna elements and operable to make electrical connection between the adjacent antenna elements across the gaps;

providing a plurality of optically controlled switch control circuits, one of the plurality of the switch control circuits coupled to each MEMS switch, each switch control circuit having an optically controlled switch close element and an optically controlled switch open element; and selectably illuminating the switch open element or the switch close element of a switch control circuit coupled to a selected MEMS switch to open or close that MEMS switch, wherein the opening or closing of selected MEMS switches reconfigures the antenna array.

13. The method as claimed in claim 12 wherein the step of selectably illuminating is provided by directing optical energy into selected optical waveguides in a superstrate having an optical waveguide network, the superstrate positioned above the antenna elements at a predetermined distance therefrom and the optical waveguides directing the optical energy onto the optically controlled switch control circuits.

14. The method as claimed in claim 13, wherein the optical waveguide network comprises:

one or more switch close waveguides, each switch close waveguide providing optical energy to the optically controlled switch close element of one or more switch control circuits; and a plurality of switch open waveguides, one of the switch open waveguides providing optical energy to the optically controlled switch open element of the switch control circuit coupled to each MEMS switch.

15. The method as claimed in claim 14, wherein the step of selectably illuminating comprises:

directing optical energy into the one or more switch close waveguides to close one or more MEMS switches; and directing optical energy into selected switch open waveguides to open the MEMS switch receiving optical energy from the selected switch open waveguide.

16. The method as claimed in claim 13, wherein the optical waveguide network comprises:

one or more switch open waveguides, each switch open waveguide providing optical energy to the optically controlled switch open element of one or more switch control circuits;

a plurality of horizontal optically controlled switch close waveguides, each horizontal switch close waveguide directing optical energy to the switch close element of one or more switch control circuits; and a plurality of vertical optically controlled switch close waveguides, each vertical switch close waveguide directing optical energy to the switch close element of one or more switch control circuits.

17. The method as claimed in claim 16, wherein the step of selectably illuminating comprises:

directing optical energy into the one or more switch open waveguides to open one or more MEMS switches;

simultaneously directing optical energy into a selected horizontal optically controlled switch close waveguide and a selected vertical optically controlled switch close waveguide, wherein the selected MEMS switch simultaneously receiving energy from the selected horizontal switch close waveguide and the selected vertical switch close waveguide is closed.

18. The method as claimed in claim 13 wherein the superstrate is RF transparent.

19. The method as claimed in claim 12 wherein each optically controlled switch control circuit comprises:

one or more photo-voltaic cells connected in series;

two control contacts;

a photoresistive cell connected between the control contacts; and a series resistance connecting the one or more photovoltaic cells to the control contacts.

20. The method as claimed in claim 19 wherein each MEMS switch is formed on a semi-insulating substrate and the photoresistive cell comprises a portion of the semi-insulating substrate.

21. The method as claimed in claim 20 wherein the antenna elements and the MEMS switches are formed on a single substrate.

22. The method as claimed in claim 20, wherein the antenna elements are formed on an antenna substrate and one or more MEMS switches is formed discreetly from and then affixed to the antenna substrate.

* * * * *